US005168738A

United States Patent [19]

Bielfeldt

[11] Patent Number: 5,168,738

[45] Date of Patent: Dec. 8, 1992

[54] CONTROL SYSTEM FOR A HYDROELASTIC DEEP-DRAWING DEVICE

[75] Inventor: Friedrich B. Bielfeldt, Eppingen, Fed. Rep. of Germany

[73] Assignee: Maschinenfabrik J. Dieffenbacher GmbH & Co., Eppingen, Fed. Rep. of Germany

[21] Appl. No.: 771,568

[22] Filed: Oct. 7, 1991

[30] Foreign Application Priority Data

Oct. 5, 1990 [DE] Fed. Rep. of Germany ..... 4031645

[51] Int. Cl.[5] ..... B21D 24/14

[52] U.S. Cl. ..... 72/21; 72/351

[58] Field of Search ..... 72/21, 22, 350, 351, 72/453.06, 453.08; 267/119

[56] References Cited

U.S. PATENT DOCUMENTS

| | | | |
|---|---|---|---|
| 4,499,750 | 2/1985 | Gerber et al. | 72/351 |
| 4,635,466 | 1/1987 | Seki et al. | 72/351 |
| 4,745,792 | 5/1988 | Story et al. | 72/351 |
| 4,896,594 | 1/1990 | Baur et al. | 72/351 |

*Primary Examiner*—Lowell A. Larson
*Attorney, Agent, or Firm*—Foley & Lardner

[57] ABSTRACT

A hydroelastic deep-drawing device for use in presses for drawing a shaped sheet-metal workpiece and a control system for the device are disclosed. The device includes a ram which is movable through a first displacement point "a" and a sheet-holding plate is supported by the spacer pins and is movable downwardly with the ram through a second displacement point"b", a starting point "s" for pre-operating displacement, and a synchronous point "c". The control system includes a control device for generating a starting signal for a working cycle when the ram reaches the first displacement position "a", for accelerating the sheet-holding plate after the sheet-holding plate reaches the second displacement position "b", and for constantly comparing the velocity of the sheet-holding plate to that of the ram and for regulating the velocity of the sheet-holding plate so that, when the third displacement point "c" is reached, the velocity of the sheet-holding plate equals the velocity of the ram. A displacement-sensor system is provided which transmits a signal when an underside of the sheet-holding plate reaches the starting point "s" of the pre-operating displacement. A device is also provided for relieving the pressure in at least some of the working cylinders of the press when the displacement-sensor system transmits the signal.

7 Claims, 8 Drawing Sheets

CONTROL SYSTEM FOR A HYDROELASTIC DEEP-DRAWING DEVICE

BACKGROUND OF THE INVENTION

1. Field of the Invention

The invention relates to a control system for a hydroelastic deep-drawing device including a ram, a plurality of hydraulic working cylinders, a plurality of spacer pins extending from selected ones of the working cylinders, and a sheet-holding plate which is supported by the spacer pins and which is movable downwardly with the ram. The deep-drawing device of this type also includes a drawing punch which is movably guided in a drawing direction of the device and which is acted on by a hydraulic medium, and a hydraulic drawing apparatus which is provided with multi-point energizing in accordance with a shaped geometry of the workpiece, the hydraulic drawing apparatus having a plurality of hydraulic control circuits, each of which activates at least one of the drawing punch and the sheet-holding plate in accordance with an effective zone of the workpiece and an effective zone of the sheet-holding plate and through which the drawing apparatus is selectively energizeable.

2. discussion of the Related Art

German Patent Application DE-P-4,008,377.2, relates to a hydroelastic deep-drawing device in presses for drawing shaped sheet-metal parts, having a sheet-holding plate supported by the tool relative to hydraulic pressure cylinders and via spacing pins. A punch is movably guided in the drawing direction and is supported on at least one piston which is guided in a cylinder and can be acted upon by hydraulic medium. This application realizes computer-assisted hydroelastic deep drawing having process capability, in which the pressure cylinders are arranged according to the hole pattern and the spacing pins are supported on the pressure cylinders for the effective zone of the sheet-holding plate, and the effective zone of the drawing punch can be activated in accordance with the shaped geometry of the workpiece.

This process is achieved by the fact that:

a) a hydraulic drawing apparatus is provided with multipoint energizing in accordance with the shaped geometry of the workpiece, in which drawing apparatus a pressure cylinder having an attachable spacing pin is allocated to each aiming point, in which arrangement a plurality of hydraulic control circuits can be connected to each pressure cylinder by rotating its cylinder shell, b) the drawing punch and/or the sheet-holding plate, via the spacing pins put onto the pressure-cylinder pistons, can be activated by one hydraulic control circuit each in accordance with the existing effective zone of the workpiece and the effective zone of the sheet-holding plate, and c) at least one differential-cylinder piston rod of the drawing punch and/or at least two differential-cylinder piston rods of the sheet-holding plate can be activated in main-cylinder guide circuits for hydraulically energizing the sheet-holding plate and the drawing punch, and, with regard to acceleration travel and braking travel as well as controlled displacement positions, each displacement position can be controlled by means of an external displacement-measuring system according to tool requirement.

With the invention according to this application, it has in particular been possible to reproduce the process advantage of an elastomeric sheet-holder drawing-cushion system, but with the advantage and the possibility of computer-assisted process control. This configuration enables a multiplicity of hydraulic cylinders to be activated in the most restricted space with process capability and computer assistance, i.e. in an identically repeatable manner during the same program, without having to provide each individual cylinder with separately energized valves.

In conventional deep-drawing forming technology, the sheet-holding plate rests on the drawing pins, which are in turn supported on a standardized central drawing-cushion plate. The drawing-cushion plate is in turn supported pneumatically or hydraulically. At high ram velocities, in particular in mechanical presses, a having impact velocities in the region of 300 mm/sec and a heavy weight of the sheet-holding plate in the region of 1 to 15 tons, the mass impact shock on the sheet to be deep drawn is so severe that impact marks occur which then become partly visible later on the formed parts. Furthermore, the surface texture of the lubricating film applied to the sheet to be deep drawn is changed in an uncontrolled manner by the impact shock, or is at least partially pushed away at critical locations, so that controlled operation of the process is no longer possible.

In this respect, it has been proposed to control more precisely the plunging of sheet-holding plates, by synchronously pre-accelerating each sheet holding plate from its stationary position ($V=0$) over the plunging stroke to the ram velocity, so that the mass impact shock can be reduced to the greatest possible extent towards zero. However, there is no solution for this with regard to the control system for a deep-drawing system or for a correspondingly advantageous device.

SUMMARY OF THE INVENTION

The object of the invention is to provide a device and to specify a control system so that the mass impact shock is eliminated during the deep-drawing operation to such an extent that impact marks on the workpiece are avoided.

In accordance with a first aspect of the invention, this object is achieved by providing a hydroelastic deep-drawing device for use in presses for drawing a shaped sheet-metal workpiece and a control system for the device. The device includes a ram which is movable through a first displacement point "a", a plurality of hydraulic working cylinders, and a plurality of spacer pins extending from selected of the working cylinders. A sheet-holding plate is supported by the spacer pins and is movable downwardly with the ram through a second displacement point "b", a starting point "s" for pre-operating displacement, and a synchronous point "c". A drawing punch is movably guided in a drawing direction of the device and is acted on by a hydraulic medium, with the sheet-holding plate being arranged higher than the drawing punch by a pre-acceleration stroke "h". A hydraulic drawing apparatus is provided with multi-point energizing in accordance with a shaped geometry of the workpiece, the hydraulic drawing apparatus having a plurality of hydraulic control circuits, each of which activates at least one of the drawing punch and the sheet-holding plate in accordance with an effective zone of the workpiece and an effective zone of the sheet-holding plate and through which the drawing apparatus is selectively energizeable. A plurality of piston rods are connected to the sheet-holding plate and a plurality of piston rods are connected to the drawing punch, each of the piston rods cooperating with a respective one of the working cylinders. A plurality of main cylinder guide circuits are provided for hydraulically energizing the sheet-holding plate and the drawing punch, each of which includes an actuator which activates at least one piston rod of the drawing punch, at least two piston rods of the sheet-holding plate, and an external displacement measuring system which controls acceleration and braking of each of the actuators.

The control system includes a control device for generating a starting signal for a working cycle when the ram reaches the first displacement position "a", for accelerating the sheet-holding plate after the sheet-holding plate reaches the second displacement position "b", and for constantly comparing the velocity of the sheet-holding plate to that of the ram and for regulating the velocity of the sheet-holding plate so that, when the third displacement point "c" is reached, the velocity of the sheet-holding plate equals the velocity of the ram. A displacement-sensor system is provided which transmits a signal when an underside of the sheet-holding plate reaches the starting point "s" of the pre-operating displacement. A device is also provided for relieving the pressure in at least some of the working cylinders when the displacement-sensor system transmits the signal.

The invention thus achieves the advantage that workpieces can be produced which are free of impact marks and therefore also require no re-work or subsequent machining to remove these defects. This, in effect, also produces a cost advantage.

Furthermore, the functional separation between the four guide cylinders and the actual working cylinders as passively acting counterholding cylinders of the floating pistons produces the following advantages:

1. The support of the sheet-holding plate, even at relatively low weights of the sheet-holding plate, e.g., 200 kN, permits a frictional support of the sheet-holding plate on the guide cylinder, since, even at a low hydraulic pressure of about 10 bar, the four hydraulically clamped cylinders permit exact regulation of the acceleration and braking ramps for the downward or upward movement. In fact, the support arrangement permits exact regulation of both the downward movement for the pre-acceleration over the displacement distance "h", and the upward movement during the release from bottom dead center to top dead center;

2. In contrast to the minimum weights of the sheet-holding plate, even heavy weights of the sheet-holding plate such as 20,000 kg can be used employing the four guide cylinders in a servo-hydraulic manner with the same valve for controlling the movement with relatively small oil quantities. This is because there are only four cylinders. Small oil quantities require only small servo-valves; i.e. small servo-valves are not only less expensive but operate more precisely in very short response times. Furthermore, by directly scanning the differential displacements between the sheet-holding plate and the TDC-point of the drawing pins, the flexibly suspended displacement-measuring sensor system permits precise pre-energizing over the measuring distance "s" for minimizing or preventing the hydraulic impact shock by the precise pre-energizing of the servo-valves. This in turn means that, due to this functional separation, the working cylinders in the effective force zones need not be activated for this pre-acceleration, which results in a substantial simplification of the hydraulic control system;

3. By this functional separation in step-by-step control of the functional area of the sheet-holding plate and the effective-zone area, following later, for the drawing pins, the mechanically dynamic impact (mass) shock on the one hand and the hydraulic impact shock in the area of the working point "c" on the other hand are reduced to the greatest possible extent towards 0;

4. On the whole, a relatively simple servo-hydraulic system comes into use for this energizing and regulation of these two operational areas for the forming process in combination with the overall conception of the drawing apparatus.

In accordance with another aspect of the invention, the displacement-sensor system includes a displacement probe which contacts the sheet-holding plate and which measures a displacement distance "e". The displacement distance comprising the pre-acceleration stroke "h" minus the pre-operating displacement stroke "s". When the displacement sensor determines that the displacement distance "e" has been reached, the displacement sensor system is operable to emit a signal for the relief of pressure in the at least some of the working cylinders. In a particularly advantageous application of the invention, the displacement distance "e" is adjustable by adjusting the position of the displacement probe according to the requirements of the workpiece.

Another object of the invention is to provide a method of controlling a hydroelastic press in which impact shock is minimized during the deep-drawing operation.

In accordance with one aspect of the invention, this object is achieved by providing a method including the steps of supporting a sheet-holding plate on a plurality of spacer pins which extend from selected ones of working cylinders, the sheet-holding plate being capable of moving downwardly with a ram, and movably guiding a drawing punch in a drawing direction of the device and which is acted on by a hydraulic medium, with the sheet-holding plate being arranged higher than the drawing punch by a pre-acceleration stroke "h". Another step includes selectively energizing the sheet-holding plate and the drawing punch through a hydraulic drawing apparatus which is provided with multi-point energizing in accordance with a shaped geometry of the workpiece, the hydraulic drawing apparatus having a plurality of hydraulic control circuits, each of which activates at least one of the drawing punch and the sheet-holding plate in accordance with an effective zone of the workpiece and an effective zone of the sheet-holding plate. Also provided is the step of hydraulically energizing the sheet-holding plate and the drawing punch via energization of a plurality of main cylinder guide circuits. The energizing step comprises energizing actuators, each of which activates at least one piston rod of the drawing punch and at least two piston rods of the sheet-holding plate. Other steps include moving a ram downwardly through a first displacement position "a", generating a starting signal for a working cycle when the ram reaches the first displacement position "a", moving the sheet-holding plate downwardly, accelerating the sheet-holding plate after the sheet-holding plate reaches a second displacement position "b" located below the first displacement position "a". A subsequent step includes constantly comparing the velocity of the sheet-holding plate to that of the ram and for regulating the velocity of the sheet-holding plate so that, when a third displacement point "c" is reached, the velocity of the sheet-holding plate equals the velocity of the ram. Other steps include transmitting a signal from a displacement-sensor system when an underside of the sheet-holding plate reaches a starting point "s" of a pre-operating displacement, and relieving the pressure in at least some of the working cylinders when the displacement-sensor system transmits the signal.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The above and further objects of the invention will become more readily apparent as the invention is more clearly understood from the detailed description to follow, reference being had to the accompanying drawings in which like reference numerals represent like parts throughout, and in which.

Figure 1:
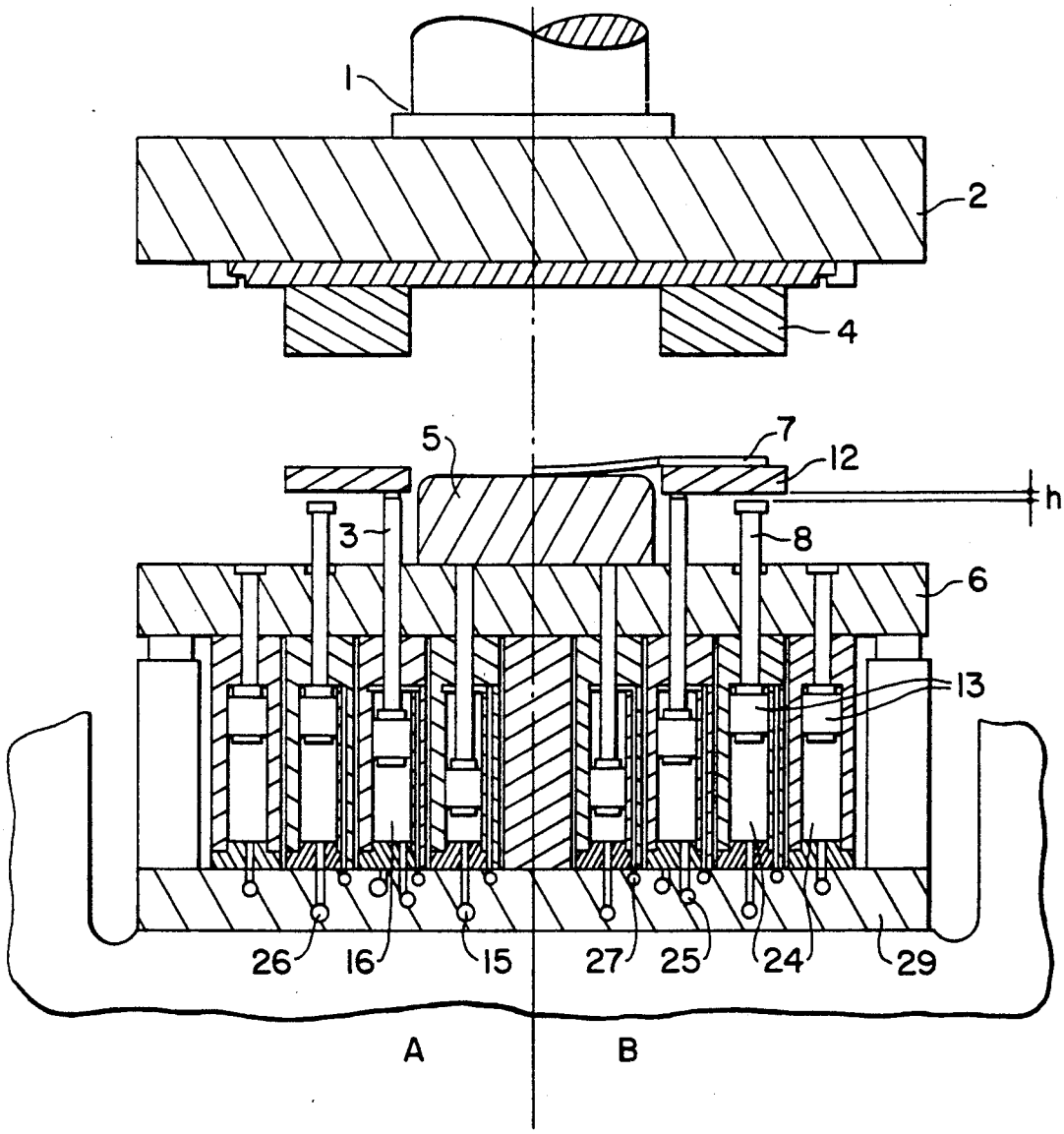
FIG. 1 shows a deep-drawing press according to the invention in the open working position.
Figure 7:
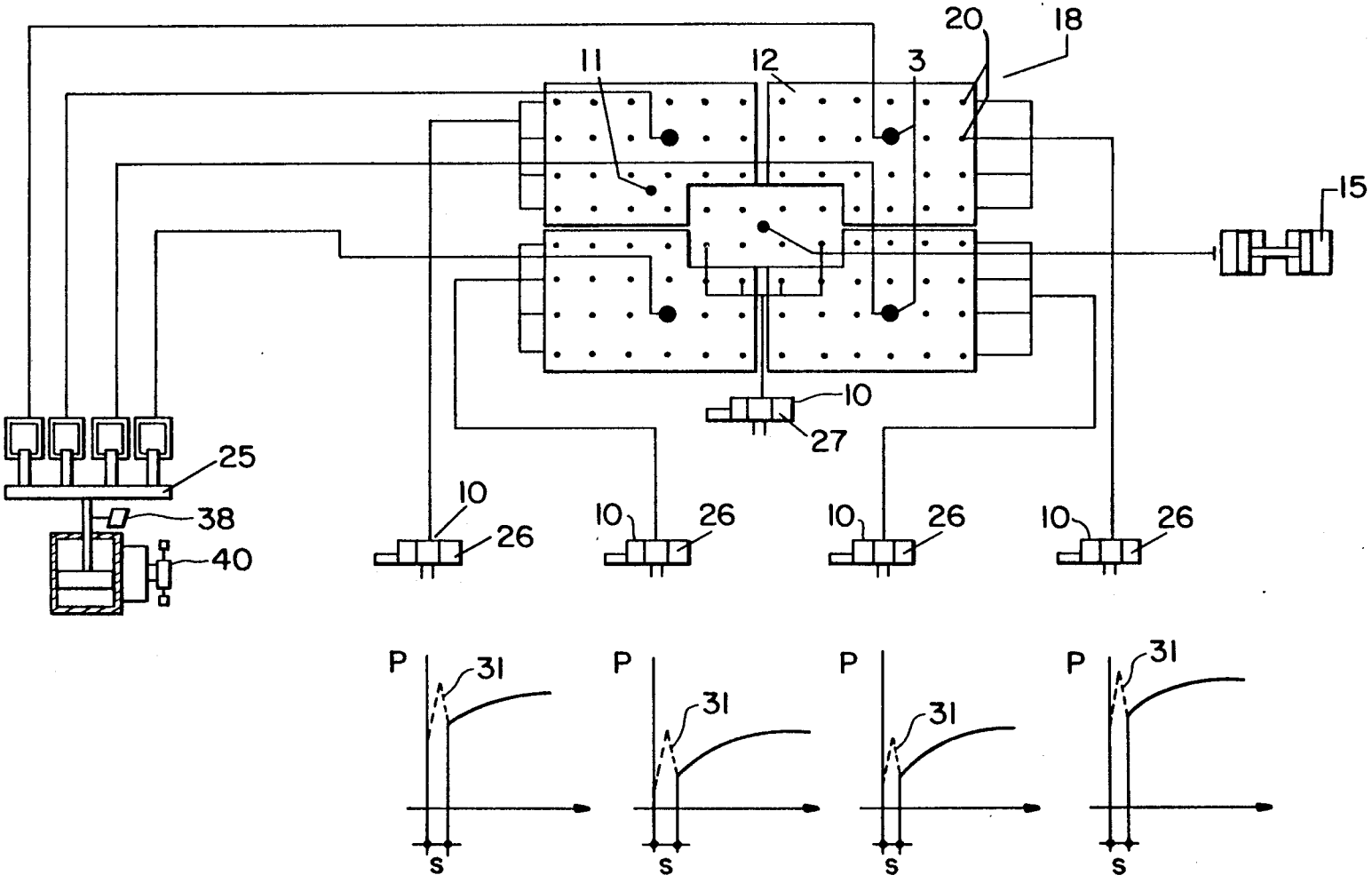
FIG. 7 shows the hole pattern for the tool-change clamping plate with the allocated effective zones and hydraulic control circuits, and FIG. 8 schematically shows a control system for the deep-drawing press of FIG. 1.
Figure 8:
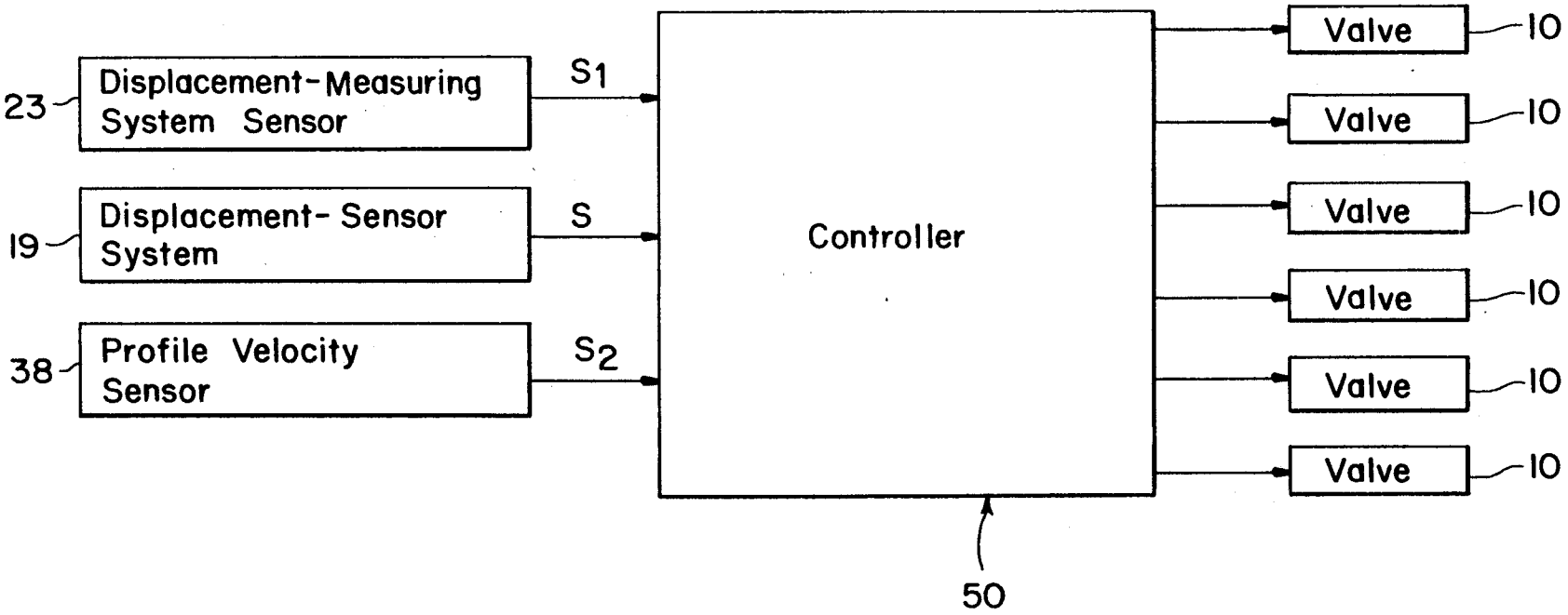

To realize the hydroelastic deep drawing with a plurality of hydraulic control circuits in a manner such as that disclosed in DE-P-4,008,377.2, working cylinder pressure cylinders 24 and/or the differential cylinders 16 are set up perpendicularly and close together on a base plate 29 in accordance with a hole pattern 18 in a tool-change clamping plate 6 illustrated in FIGS. 1 and 7 to form a cylinder plate. Each of the working cylinders 24 and differential cylinders 16 are fixed to a base plate 29 by means of screw bolts and square flanges which bear on the top end face of the cylinder shells. In this arrangement, a pressure cylinder having attachable spacing pins is allocated to each aiming point 20 in accordance with the shaped geometry of the workpiece 7, and a plurality of hydraulic control circuits 26 and 27 can be connected to each pressure cylinder by rotation of its cylinder shell. In addition, each of a drawing punch 5 and/or a sheet-holding plate 12, via spacer pins put onto the floating pistons 13, can be activated by one hydraulic control circuit 26 and 27 in accordance with the existing effective zone 21 of the workpiece and the effective zone 22 of the sheet-holding plate 12. Furthermore, via differential cylinders 16 and differential piston rods 3, at least one differential-cylinder piston rod 3 of the drawing punch 5 and/or at least two differential-cylinder piston rods 3 of the sheet-holding plate 12 can be activated in main-cylinder guide circuits 15 and 25 for hydraulically energizing the sheet-holding plate 12 and the drawing punch 5. Each displacement position can be controlled by means of an external displacement-measuring system 23 according to tool requirements with regard to acceleration travel and braking travel as well as controlled displacement positions.

FIG. 1 shows the initial position in the working cycle of a deep-drawing press 1. The ram 2 is in the top position and the mechanical drawing pins 8 are located in their topmost working position. The latter are in turn supported on the floating pistons 13, which are likewise located at the top mechanical stop. The sheet-holding plate 12 is supported on four differential pistons 16. The four differential cylinders 16, functioning as guide cylinders for the sheet-holding plate 12, are hydraulically connected to the central main cylinder and a guide circuit 25 for the sheet-holding plate. The four differential cylinders 16 are hydraulically guided in synchronism in their downward and upward movement by this guide circuit 25. As a result, the sheet-holding plate 12 is always held in a parallel and horizontal position in a frictional manner on the four differential cylinders 16. In accordance with the requisite pre-acceleration stroke "h", the differential cylinders 16 are moved out further relative to the drawing pins 8. The available sheet 7 to be deep drawn is moved by a transport system into the sheet-holding area of the tool and deposited. Since the sheet-holding plate 12 is higher relative to the drawing punch 5, the relatively thin sheet sags or bulges through the die aperture in the sheet-holding plate 12 and is supported centrally on the drawing punch 5.

Figure 2:
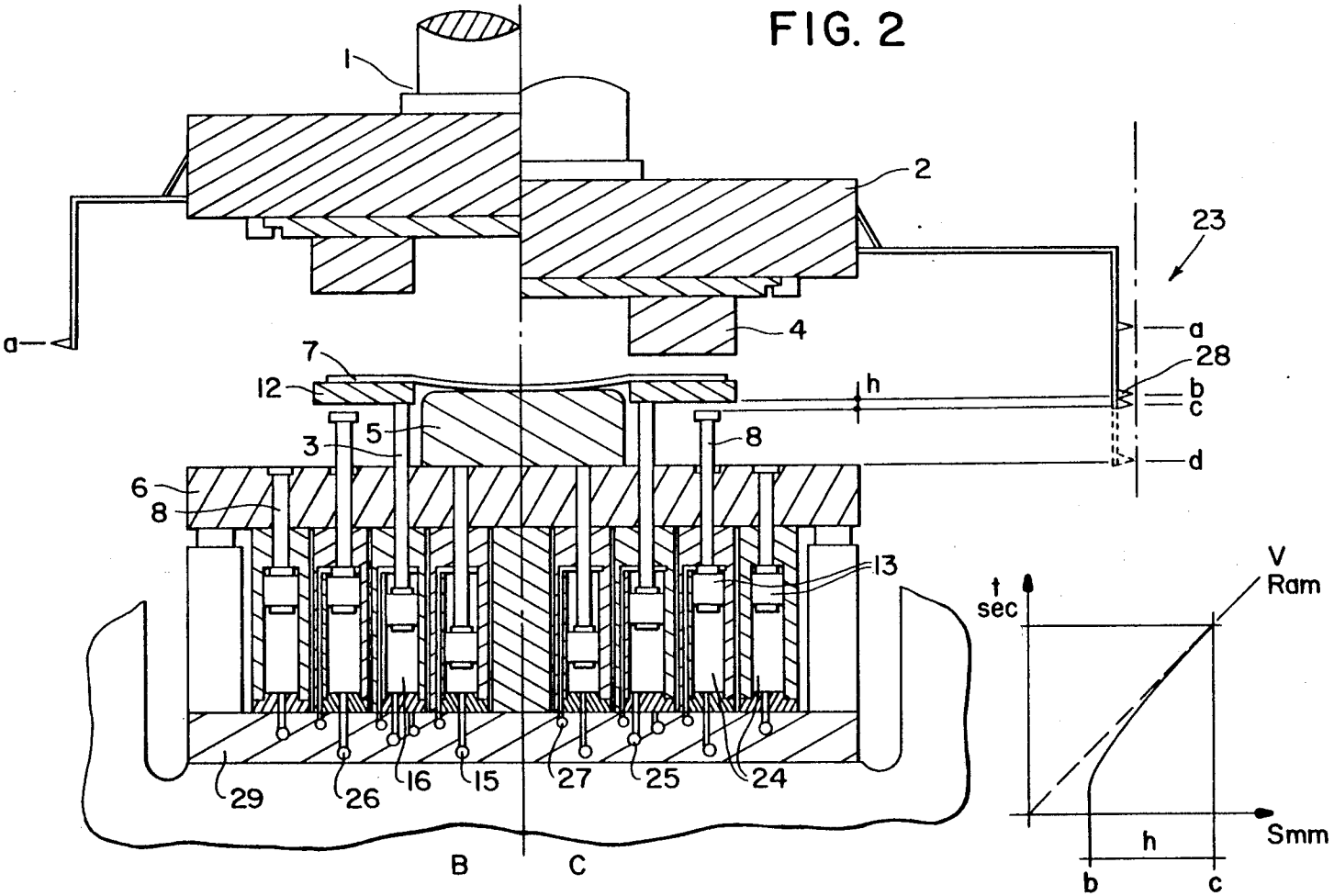
FIG. 2 shows the deep-drawing press according to FIG. 1 in the open and partly lowered position with a time-displacement diagram.
Figure 3:
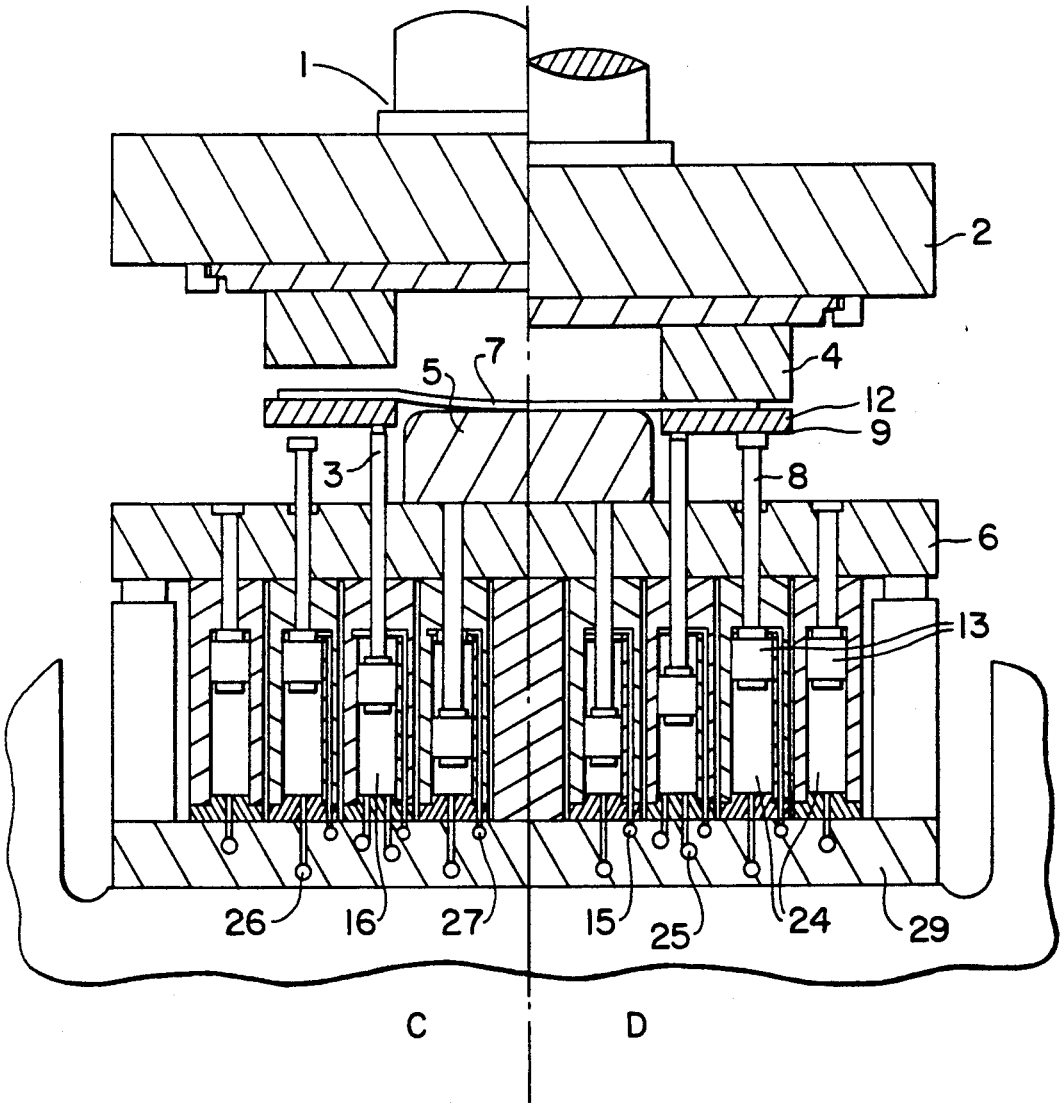
FIG. 3 shows the deep-drawing press according to FIG. 1 just before the drawing-die part strikes the workpiece and when the drawing-die part strikes the workpiece.

FIG. 2 shows the ram 2 both in the starting position and in the operating positions of the displacement-measuring system 23 for the ram 2 which generates and outputs a signal, indicative of the speed and/or position of the ram 2. The starting signal for the working cycle is triggered at the displacement point "a" by the contact maker 28.

If the contact maker 28 reaches the displacement point "b", the sheet-holding plate 12 is accelerated over the pre-acceleration stroke "h" from the velocity $V=0$ to the synchronous point "c" by regulating the support of sheet-holding plate 12.

The velocity profile of the main cylinder system 25, represented by a signal $S_2$ generated by a sensor 38 in FIG. 7, which moves in synchronism with sheet-holding plate 12, is constantly compared with the ram velocity in a servo-hydraulic manner via a controller 56 and controlled in a manner which is known to that skilled in the art during the acceleration of the sheet-holding plate 12 operation of valve 40 to control acceleration of the sheet-holding plate 12 such that the velocity of the sheet-holding plate 12 is $_{v}SHEET = {}_{v}RAM$ when the displacement point "c" is reached With the device described, the synchronous point "c" in FIG. 2 meets the preconditions explained below The impact shock is approximately 0 due to the synchronization of the velocity of the ram 2 and the sheet-holding plate 12.

The sagging of the sheet 7 to be deep drawn is compensated automatically, in the course of which the working point "c" can be selected with the control points "b" and "a" in front of it (i.e., above it) in such a way that the sheet to be deep drawn assumes an optimum position specific to the forming operation between sheet-holding plate 12 and drawing punch 5. This position may be a horizontal position or one in which the sheet is arched very slightly upward by the drawing punch 5.

The underside 9 of the sheet-holding plate 12 will strike the drawing pins 8 in the top dead center position.

The hydraulic impact-shock overtravel 31, which would occur at the hydraulically preloaded, floating pistons 13, is reduced by the pre-energizing of the servo-valves 10 by controller 50 in the hydraulic control circuit 26 according to FIG. 7 for the four effective force zones chosen in this exemplary embodiment At an operating time of the servo-valves of t=15 ms, the pre-energizing period corresponds to approximately T=25 ms.

Such short times require reliable sensory detection of the displacement position of the sheet-holding plate 12 relative to the top dead center of the drawing pins 8 (see FIG. 6) during the plunging movement over the pre-acceleration distance "h".

Figure 6:
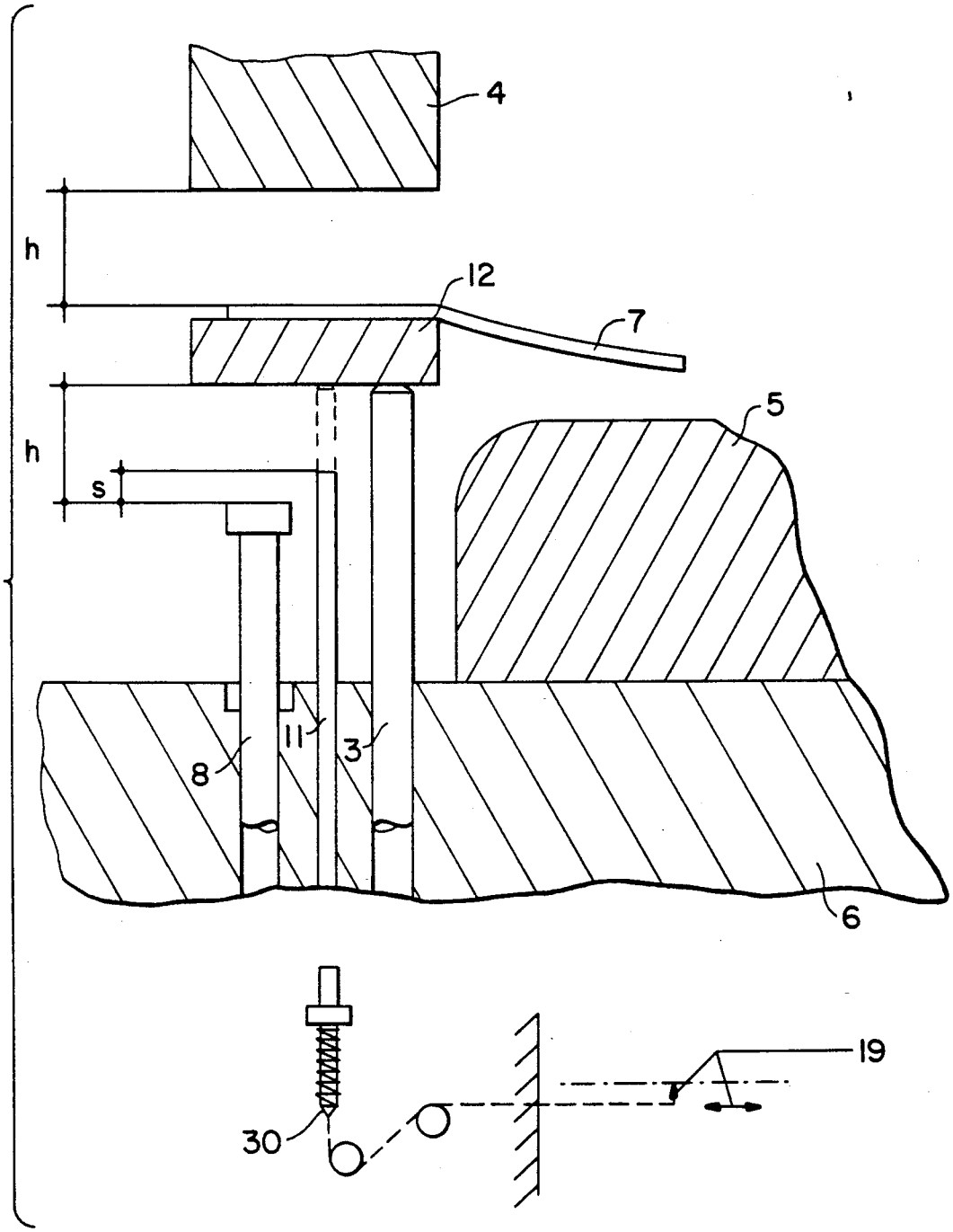
FIG. 6 shows a partial section of the deep-drawing press according to FIG. 1 with a displacement-sensor system.

For this reason, it is advantageous to arrange a flexibly arranged displacement probe 11 in the area of the effective force zones below the projected surface of the sheet-holding plate 12 in order to detect the pre-operating displacement "s" (FIG. 6). This may be explained by the fact that, at relatively high ram velocities of mechanical crank presses such as V=300 mm/sec, the operating displacement "s"=7.5 mm. In slower hydraulic presses having, for example, press velocities of only 40 mm/sec, this operating displacement "s" is merely 1 mm.

The accurate setting of the pre-operating displacement stroke "s" by a displacement-sensor system 19, with due regard to the different working velocities in the pre-acceleration section "h", in particular directly before point "c", is important. For this reason, the flexibly suspended displacement probe 11 is mechanically integrated in the drawing apparatus, for example by a cable control element 30, in such a way that a readily accessible adjustment from outside is possible. The probe is also integrated in such a way that this adjusting displacement can also be preset by a central computer by means of an additional final control element.

Figure 4:
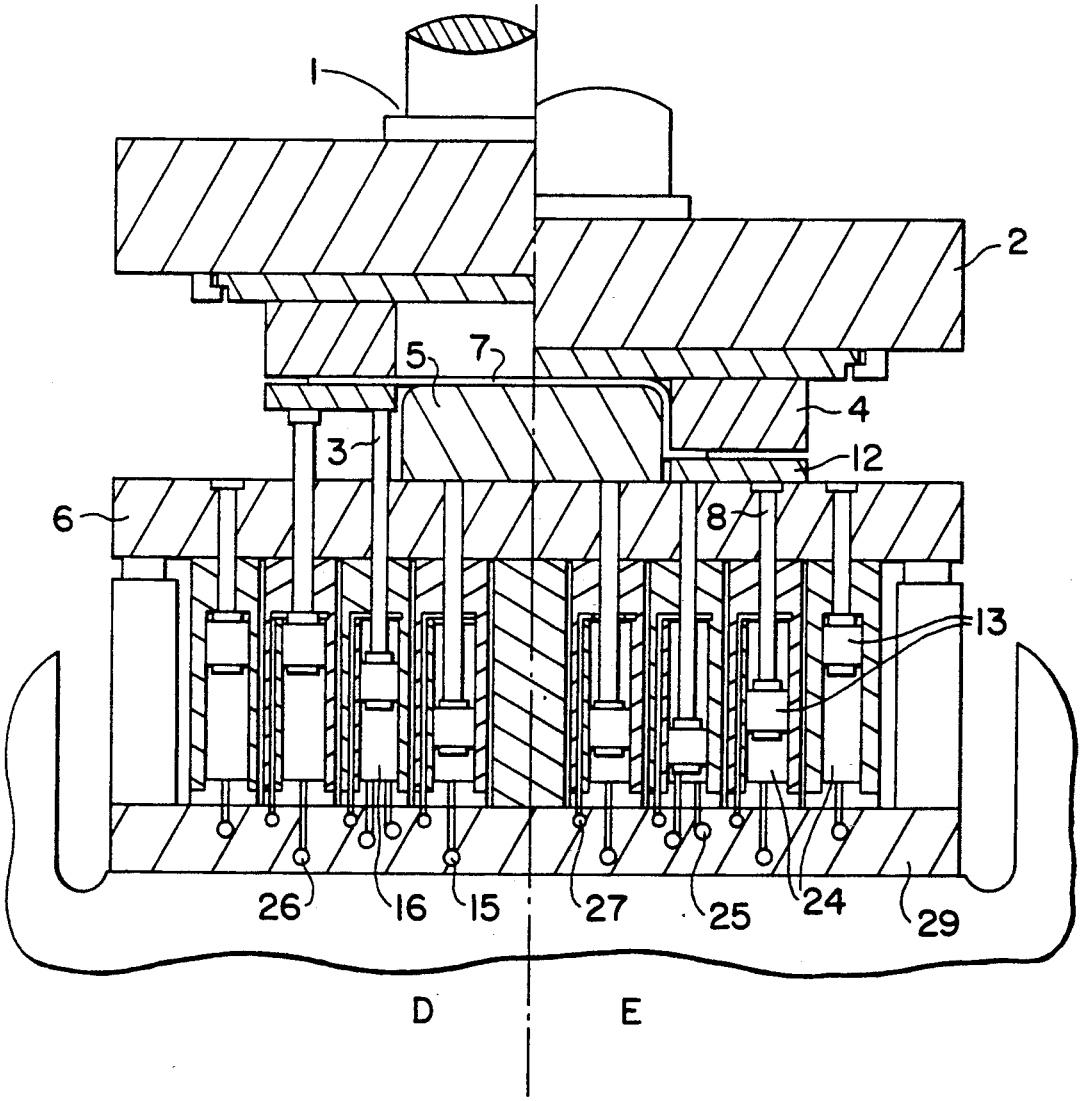
FIG. 4 shows the deep-drawing press according to FIG. 1 when the drawing-die part strikes the workpiece and in the closed working position.

FIG. 4 shows the working sequence of the drawing apparatus according to FIG. 7 from the working point "c", illustrated in the position C, down to the bottom dead center (BDC) illustrated in the position D and constituting the end of the forming process. The displacement signal "d" is produced at this position.

Figure 5:
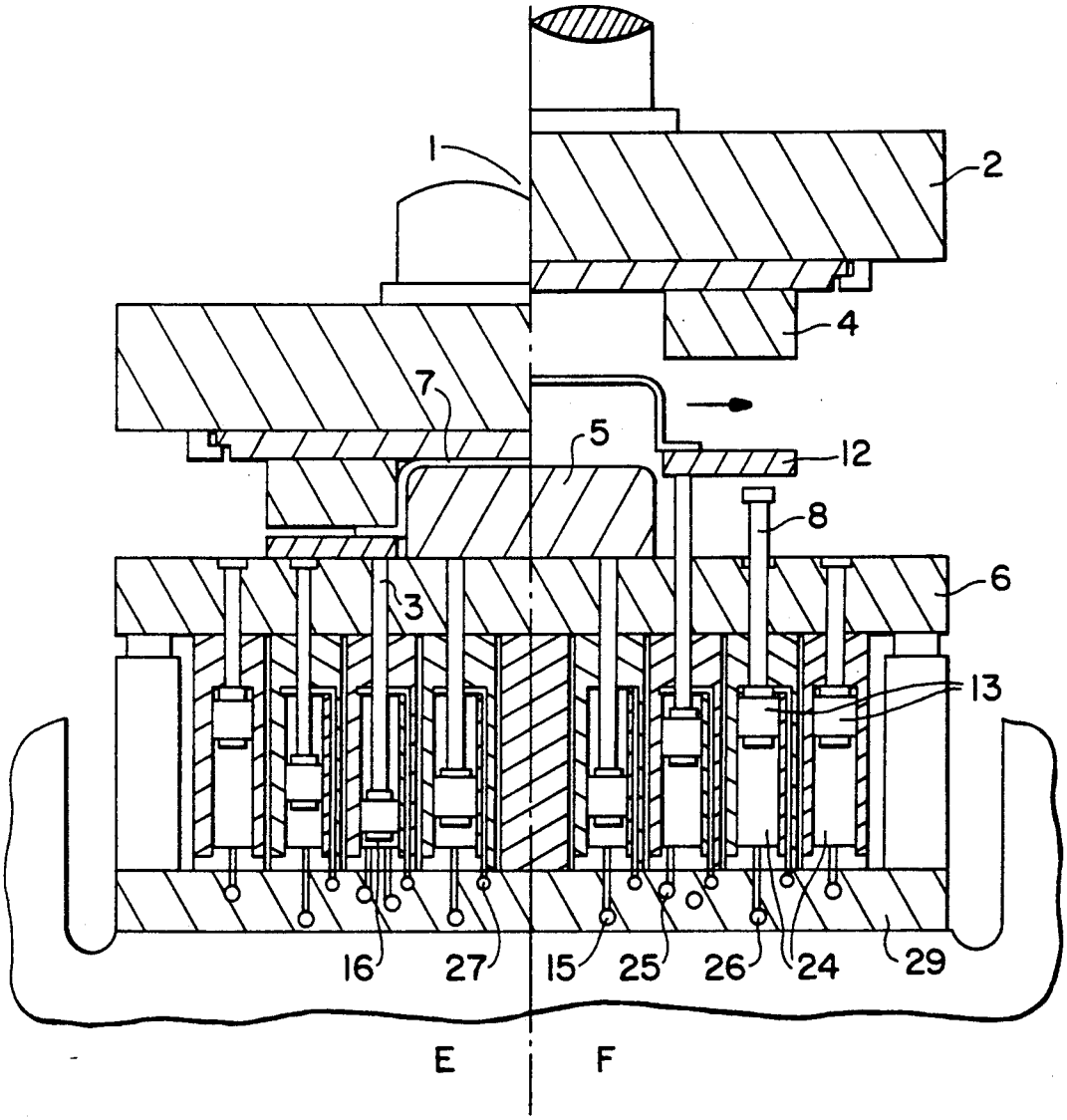
FIG. 5 shows the deep-drawing press according to FIG. 1 in the closed and partly open working position.

FIG. 5 shows the resetting of the sheet-holding plate 12 from the position E to the position F representing movement, after the forming process is complete, into the initial position of the sheet-holding plate 12 relative to the top dead center TDC of the same. In the course of this operation, the press is controlled such that the resetting velocity equals the ram velocity.

The floating pistons 13 on which the mechanical drawing pins 8 are supported follow the four differential cylinders 16 at a reduced velocity, although so quickly that the drawing pins 8 have reached their top dead center position by the time the ram 2 starts a working cycle again with the downward signal "a".

FIG. 6 illustrates clearly the functional separation between the control of the pre-acceleration for the sheet-holding plate 12 and the minimizing of the hydraulic impact shock on the mechanical drawing pins 8 by the pre-operating displacement "s" and the displacement-sensor system 19.

What is claimed is:

1. A system comprising:

(A) hydroelastic deep-drawing device for use for drawing a shaped sheet-metal workpiece, said device including (a) a ram which is movable through a first displacement point "a", (b) a plurality of hydraulic working cylinders, and a plurality of spacer pins extending from selected ones of said working cylinders, (c) a sheet-holding plate which is supported by said spacer pins and which is movable downwardly with said ram through a second displacement point "b", a starting point "s" for a pre-operating displacement stroke, and a synchronous point "c", (d) a drawing punch which is movably guided in a drawing direction of said device and which is acted on by a hydraulic medium, said sheet-holding plate being arranged higher than said drawing punch by a pre-acceleration stroke "h", (e) a hydraulic drawing apparatus which is provided with multi-point energizing in accordance with a shaped geometry of said workpiece, said hydraulic drawing apparatus having a plurality of hydraulic control circuits, each of which activates at least one of said drawing punch and said sheet-holding plate in accordance with an effective zone of said workpiece and an effective zone of said sheet-holding plate and through which said drawing apparatus is selectively energizeable, (f) a plurality of piston rods connected to said sheet-holding plate and a plurality of piston rods connected to said drawing punch, each of said piston rods cooperating with a respective one of said working cylinders, (g) a plurality of main cylinder guide circuits for hydraulically energizing said sheet-holding plate and said drawing punch, each of which includes an actuator which activates at least one piston rod of said drawing punch and at least two piston rods of said sheet-holding plate, and (h) an external displacement measuring system which controls acceleration and braking of each of said actuators; and (B) a control system for said hydroelastic deep-drawing device, said control system including (a) a control device for generating a starting signal for a working cycle when said ram reaches said first displacement position "a", for accelerating said sheet-holding plate after said sheet-holding plate reaches said second displacement position "b", and for constantly comparing the velocity of said sheet-holding plate to that of said ram and for regulating the velocity of said sheet-holding plate so that, when said synchronous point "c" is reached, the velocity of said sheet-holding plate equals the velocity of said ram, (b) a displacement-sensor system which transmits a signal when an underside of said sheet-holding plate reaches said starting point of said pre-operator displacement stroke "s", and (c) a device for relieving the pressure in at least some of said working cylinders when said displacement-sensor system transmits said signal.

2. The control system as claimed in claim 1, wherein said displacement-sensor system includes a displacement probe which contacts said sheet-holding plate and which measures a displacement distance "e", said displacement distance comprising said pre-acceleration stroke "h" minus said pre-operating displacement stroke "s", wherein, when said displacement sensor determines that said displacement distance "e" has been reached, said displacement sensor system is operable to emit a signal for the relief of pressure in said at least some of said working cylinders.

3. The control system as claimed in claim 2, wherein said displacement distance "e" is adjustable by adjusting the position of said displacement probe according to the requirements of said workpiece.

4. A method comprising:

(A) supporting a sheet-holding plate on a plurality of spacer pins which extend from selected ones of working cylinders, said sheet-holding plate being capable of moving downwardly with a ram;

(B) movably guiding a drawing punch in a drawing direction of said device, said sheet-holding plate being arranged higher than said drawing punch by a pre-acceleration stroke "h";

(C) selectively energizing said sheet-holding plate and said drawing punch through a hydraulic drawing apparatus which is provided with multi-point energizing in accordance with a shaped geometry of said workpiece, said hydraulic drawing apparatus having a plurality of hydraulic control circuits, each of which activates at least one of said drawing punch and said sheet-holding plate in accordance with an effective zone of said workpiece and an effective zone of said sheet-holding plate;

(D) hydraulically energizing said sheet-holding plate and said drawing punch via energization of a plurality of main cylinder guide circuits, said energizing step comprising energizing actuators, each of which activates at least one piston rod of said drawing punch and at least two piston rods of said sheet-holding plate, (E) moving a ram downwardly through a first displacement position "a";

(F) generating a starting signal for a working cycle when said ram reaches said first displacement position "a", (G) moving said sheet-holding plate downwardly;

(H) accelerating said sheet-holding plate after said sheet-holding plate reaches a second displacement position "b" located below said first displacement position "a", then (I) constantly comparing the velocity of said sheet-holding plate to that of said ram and for regulating the velocity of said sheet-holding plate so that, when a third displacement point "c" is reached, the velocity of said sheet-holding plate equals the velocity of said ram, (J) transmitting a signal from a displacement-sensor system when an underside of said sheet-holding plate reaches a starting point "s"of a pre-operating displacement, and (K) relieving the pressure in at least some of said working cylinders when said displacement-sensor system transmits said signal.

5. A system comprising:

(A) hydroelastic deep-drawing device for use in presses for drawing a shaped sheet-metal workpiece, said device including (a) a ram which is movable through a first displacement point "a", (b) a plurality of hydraulic working cylinders, (c) a sheet-holding plate which is supported by selected ones of said working cylinders and end displacement point "b", a starting point "s" for pre-operating displacement, and a synchronous point "c", (d) a drawing punch which is movably guided in a drawing direction of said device, which is supported on selected ones of said working cylinders, and which is acted on by a hydraulic medium, said sheet-holding plate being arranged higher than said drawing punch by a pre-acceleration stroke "h", (B) a control system for said hydroelastic deep-drawing device, said control system including (a) a control device for generating a starting signal for a working cycle when said ram reaches said first displacement position "a", accelerating said sheet-holding plate after said sheet-holding plate reaches said second displacement position "b", and constantly comparing the velocity of said sheet-holding plate to that of said ram and for regulating the velocity of said sheet-holding plate so that, when said third displacement point "c" is reached, the velocity of said sheet-holding plate equals the velocity of said ram, (b) a displacement-sensor system which transmits a signal when an underside of said sheet-holding plate reaches said starting point "s" of said pre-operating displacement, and (c) a device for relieving the pressure in at least some of said working cylinders when said displacement-sensor system transmits said signal.

6. The control system as claimed in claim 5, wherein said displacement-sensor system includes a displacement probe which contacts said sheet-holding plate and which measures a displacement distance "e", said displacement distance comprising said pre-acceleration stroke "h" minus said pre-operating displacement stroke "s", wherein, when said displacement sensor determines that said displacement distance "e" has been reached, said displacement sensor system being operable to emit a signal for the relief of pressure in said at least some of said working cylinders.

7. The control system as claimed in claim 6, wherein said displacement distance "e" is adjustable by adjusting the position of said displacement probe according to the requirements of said workpiece.

* * * * *